US007301465B2

(12) United States Patent
Tengshe et al.

(10) Patent No.: US 7,301,465 B2
(45) Date of Patent: Nov. 27, 2007

(54) DROWSY DRIVING ALARM SYSTEM

(76) Inventors: Vishwas V. Tengshe, 141-20 85th Rd., Apartment 3F, Jamaica, New York, NY (US) 11435; Venkatesh G. Tengshe, 141-20 85th Rd., Apartment 3F, Jamaica, New York, NY (US) 11435

( * ) Notice: Subject to any disclaimer, the term of this patent is extended or adjusted under 35 U.S.C. 154(b) by 134 days.

(21) Appl. No.: 11/087,657

(22) Filed: Mar. 24, 2005

(65) Prior Publication Data

US 2006/0214807 A1 Sep. 28, 2006

(51) Int. Cl.
*G08B 23/00* (2006.01)

(52) U.S. Cl. ..... 340/575; 340/576; 382/100; 382/181; 382/276

(58) Field of Classification Search ..... 340/575
See application file for complete search history.

(56) References Cited

U.S. PATENT DOCUMENTS

| | | | | |
|---|---|---|---|---|
| 2,724,109 | A | 11/1955 | Skolnick et al. | 340/575 |
| 2,726,380 | A | 12/1955 | Campisi | 340/526 |
| 3,524,030 | A | 8/1970 | Wiegel | 200/52 R |
| 3,953,831 | A | 4/1976 | Estrada | 340/575 |
| 4,144,531 | A | 3/1979 | Anbergen | 340/575 |
| 4,145,122 | A | 3/1979 | Rinard et al. | 351/210 |
| 4,659,197 | A | 4/1987 | Weinblatt | 351/210 |
| 4,725,824 | A | 2/1988 | Yoshioka | 340/575 |
| 4,875,030 | A | 10/1989 | Chiu | 340/575 |
| 4,967,186 | A | 10/1990 | Ludmirsky et al. | 340/575 |
| 5,360,971 | A | 11/1994 | Kaufman et al. | 250/221 |
| 5,402,109 | A | 3/1995 | Mannik | 340/575 |
| 5,469,143 | A | 11/1995 | Cooper | 340/575 |
| 5,566,067 | A | 10/1996 | Hobson et al. | 364/419.2 |
| 5,570,698 | A * | 11/1996 | Liang et al. | 340/575 |
| 5,583,590 | A | 12/1996 | Clupper | 351/200 |
| 5,786,765 | A | 7/1998 | Kumakura et al. | 340/576 |
| 5,878,156 | A * | 3/1999 | Okumura | 340/575 |
| 5,982,287 | A | 11/1999 | Brannen et al. | 340/575 |
| 6,087,941 | A | 7/2000 | Ferraz | 340/575 |
| 6,097,295 | A | 8/2000 | Griesinger et al. | 340/576 |
| 6,115,654 | A * | 9/2000 | Eid et al. | 340/945 |
| 6,147,612 | A | 11/2000 | Ruan et al. | 340/575 |
| 6,243,015 | B1 | 6/2001 | Yeo | 340/576 |
| 6,265,978 | B1 * | 7/2001 | Atlas | 340/575 |

(Continued)

FOREIGN PATENT DOCUMENTS

| | | |
|---|---|---|
| GB | 2 129 989 A | 5/1984 |

*Primary Examiner*—Benjamin C. Lee
*Assistant Examiner*—Eric M. Blount
(74) *Attorney, Agent, or Firm*—Richard C. Litman

(57) ABSTRACT

A drowsy driving alarm system includes a monitoring mechanism with a camera and an indicator mechanism carrying drowsy driving software and a processor to process data received from the camera regarding drowsiness of a user of the drowsy driving alarm system. The monitoring mechanism can include at least one power source, at least one interface connection, at least one speaker, and a communication bus communicatively interconnecting elements of the monitoring mechanism. The monitoring mechanism can include at least one visual, audible, and/or physical indicator, a microphone, a transceiver, an antenna, at least one sensor and a compass. The indicator mechanism can include at least one display, at least one visual indicator, and a communication bus interconnecting elements of the indicator mechanism. The indicator mechanism can include at least one power source, and at least one interface connection. The indicator mechanism can include at least one audible and/or physical indicator.

13 Claims, 5 Drawing Sheets

U.S. PATENT DOCUMENTS

| | | | | |
|---|---|---|---|---|
| 6,304,187 | B1 | 10/2001 | Pirim | 340/576 |
| 6,346,887 | B1 * | 2/2002 | Van Orden et al. | 340/575 |
| 6,353,396 | B1 * | 3/2002 | Atlas | 340/575 |
| 6,496,117 | B2 * | 12/2002 | Gutta et al. | 340/576 |
| 6,542,081 | B2 * | 4/2003 | Torch | 340/575 |
| 6,559,770 | B1 | 5/2003 | Zoerb | 340/575 |
| 6,637,883 | B1 | 10/2003 | Tengshe et al. | 351/210 |
| 6,717,518 | B1 * | 4/2004 | Pirim et al. | 340/576 |
| 6,927,694 | B1 * | 8/2005 | Smith et al. | 340/576 |
| 7,116,234 | B2 * | 10/2006 | Mohri | 340/575 |
| 2002/0165462 | A1 | 11/2002 | Westbrook et al. | 600/529 |
| 2004/0090334 | A1 * | 5/2004 | Zhang et al. | 340/575 |
| 2004/0183685 | A1 * | 9/2004 | Strumolo et al. | 340/575 |
| 2005/0185243 | A1 * | 8/2005 | Wenstrand | 340/576 |

* cited by examiner

DROWSY DRIVING ALARM SYSTEM

BACKGROUND OF THE INVENTION

1. Field of the Invention

The present invention generally relates to alarm systems and, more particularly, to a drowsy driving alarm system.

2. Description of Related Art

A person has a tendency to get drowsy due to fatigue and/or repetitive nature of the job they do. Some prescription medications also have drowsiness as their main side effect. Drowsy drivers have an impact on safety on the roadways and a wide variety of arrangements for monitoring and alerting drivers who begin to fall asleep or become tired are known. However, there are currently no effective devices in the market that alert the driver in a timely manner. Typically when a driver becomes drowsy and/or begins to fall asleep, their head moves backwards and forwards. Many existing devices concentrate on this behaviour to alert the driver. However, this is too late. Even a fraction of a second delay in alerting the driver is potentially fatal. The device needs to be able to alert the driver before that. Other devices are too obtrusive and involve complex configurations. Car manufacturers are trying to introduce features of their own that are too expensive and frankly not needed.

Therefore, a need exists to provide a drowsy driver alarm system to alert drowsy drivers quickly and effectively.

SUMMARY OF THE INVENTION

The present invention is a drowsy driving alarm system. The drowsy driving alarm system includes a the drowsy driving alarm system includes a monitoring mechanism with a camera and an indicator mechanism carrying drowsy driving software and a processor to process data received from the camera regarding drowsiness of a user of the drowsy driving alarm system. The monitoring mechanism can include at least one power source, at least one interface connection, at least one speaker, and a communication bus communicatively interconnecting elements of the monitoring mechanism. The monitoring mechanism can include at least one visual indicator, at least one audible indicator, and/or at least one physical indicator. The monitoring mechanism can include a microphone, a transceiver and an antenna. The monitoring mechanism can also include at least one sensor and a compass.

The monitoring mechanism includes an ear cradle to cradle the ear, and a longitudinal arm with the camera positioned at an end of the arm, the arm being pivotally attached to the ear cradle to enable the position of the arm to be adjusted. A light source can be mounted on the camera to illuminate the eye. Once adjusted, the arm supports the camera in a manner to substantially fix the position of the camera relative to a position of the pupil of the user's eye.

The indicator mechanism can include at least one display, at least one visual indicator, and a communication bus interconnecting elements of the indicator mechanism. The indicator mechanism can include at least one-power source, and at least one interface connection. The indicator mechanism can include at least one audible indicator and/or at least one physical indicator.

The drowsy driving software, when executed by the processor of the indicator mechanism, causes the indicator mechanism to carry out steps including effecting program initialization of the drowsy driving alarm system; conducting a system check to determine whether components of the drowsy driving alarm system are operating properly; and tracking the eye of a user with the camera if the drowsy driving alarm system is operationally sound.

The conducting a system check step further causes the indicator mechanism to return to the program initialization step if the drowsy driving alarm system is not operationally sound. The drowsy driving software, when executed by the processor of the indicator mechanism, can further cause the processor of the indicator mechanism to carry out steps including determining whether an eye of a user is drowsy, and alarming the user if a determination is made that the eye is drowsy. The drowsy driving software, when executed by the processor of the indicator mechanism, further causes the processor of the indicator mechanism to carry out steps including determining whether the user is distracted or not looking in a predetermined direction, and alarming the user if the user is distracted or not looking in a predetermined direction, the user is alarmed.

A drowsy driving alarm method includes: effecting program initialization of the drowsy driving alarm system; conducting a system check to determine whether components of the drowsy driving alarm system are operating properly; and tracking the eye of a user with the camera if the drowsy driving alarm system is operationally sound.

The conducting a system check step returns to the program initialization step if the drowsy driving alarm system is not operationally sound. The drowsy driving alarm method also determines whether an eye of a user is drowsy, and alarms the user if a determination is made that the eye is drowsy. The drowsy driving alarm method also determines whether the user is distracted or not looking in a predetermined direction, and alarms the user if the user is distracted or not looking in a predetermined direction.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
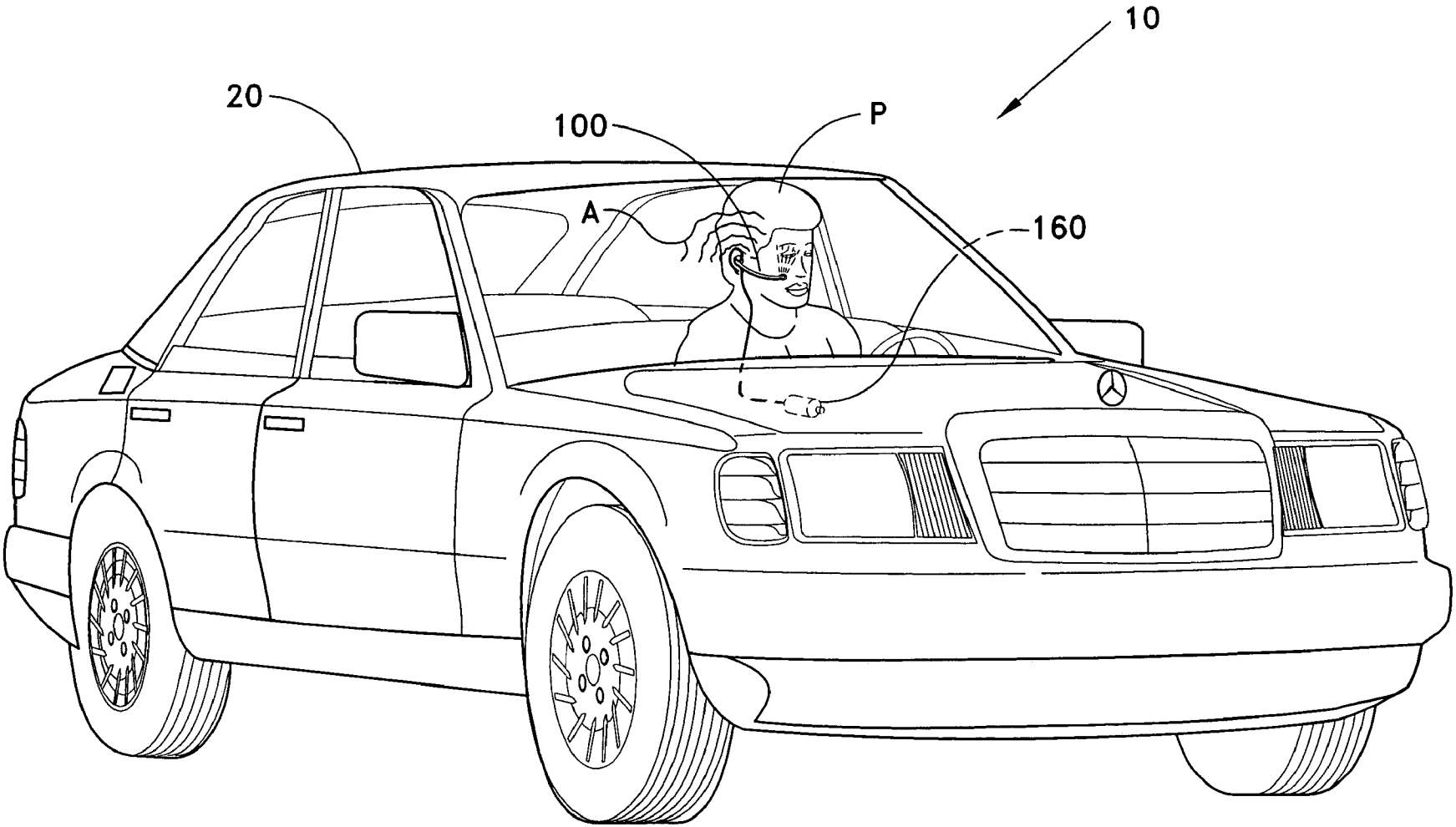
FIG. 1 is an environmental view of an individual in a vehicle using a drowsy driving alarm system according to the present invention.

The present invention is a drowsy driving alarm system. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Referring to the drawings, FIG. 1 shows an image 10 of a vehicle 20 being driven by an individual P. The individual P is utilizing a drowsy driving alarm system according to the present invention. While the drowsy driving alarm system is illustrated in use with a personal vehicle (e.g. a car), it is the full intent of the inventor that the drowsy driving alarm system can be used in any variety of situations, such as drivers of automobiles, trains, airplanes, cruise liners, as well as typical workers in offices, factories, security guards, etc.

The drowsy driving alarm system described herein can be applicable to any situation where an individual wants to be inhibited from becoming drowsy, as well as any situation involving critical mechanical operation where the operator needs to be 100% alert all the time. The drowsy alarm system can also be utilized by third parties, such as employers or the like, to monitor the drowsiness of their employees from a remote location. For example, an employer could require certain employees to wear a drowsy driving alarm system, and monitor those employees from a remote location, such as from a remote computer arrangement or monitoring arrangement.

Figure 2:
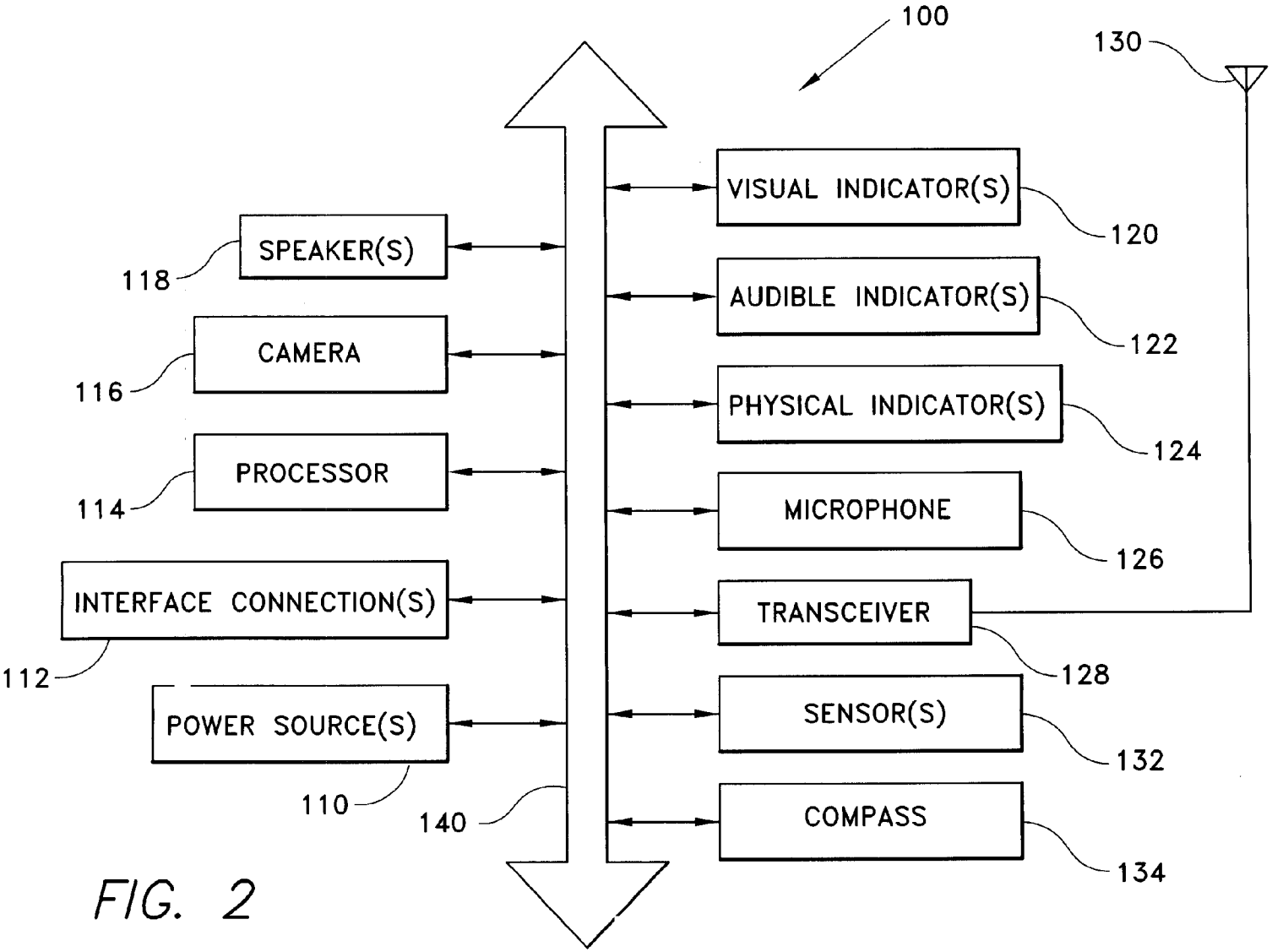
FIG. 2 is a block diagram of a monitoring device of drowsy driving alarm system according to the present invention.
Figure 3:
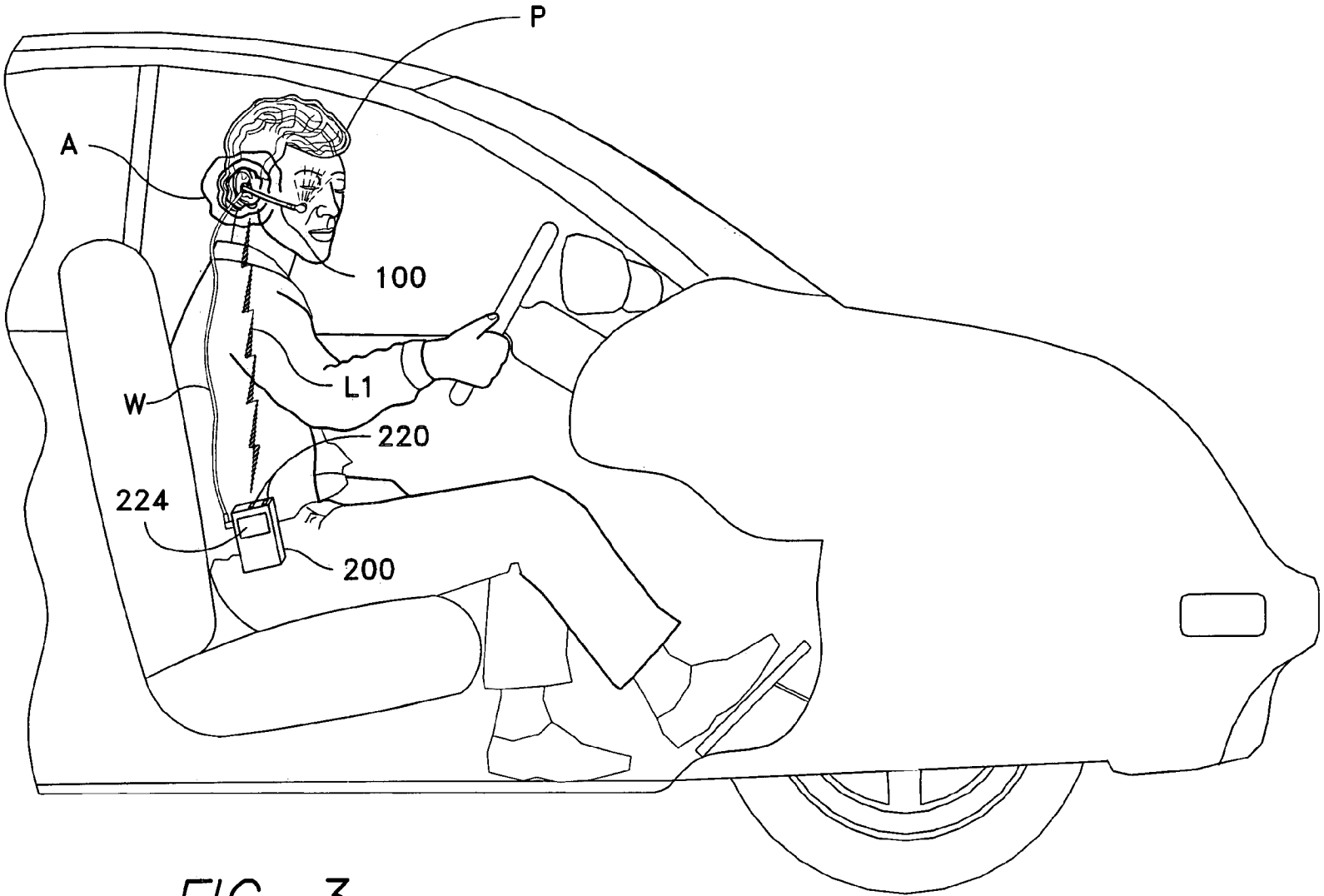
FIG. 3 is a sectional view of an individual in a vehicle using a drowsy driving alarm system according to the present invention.
Figure 4:
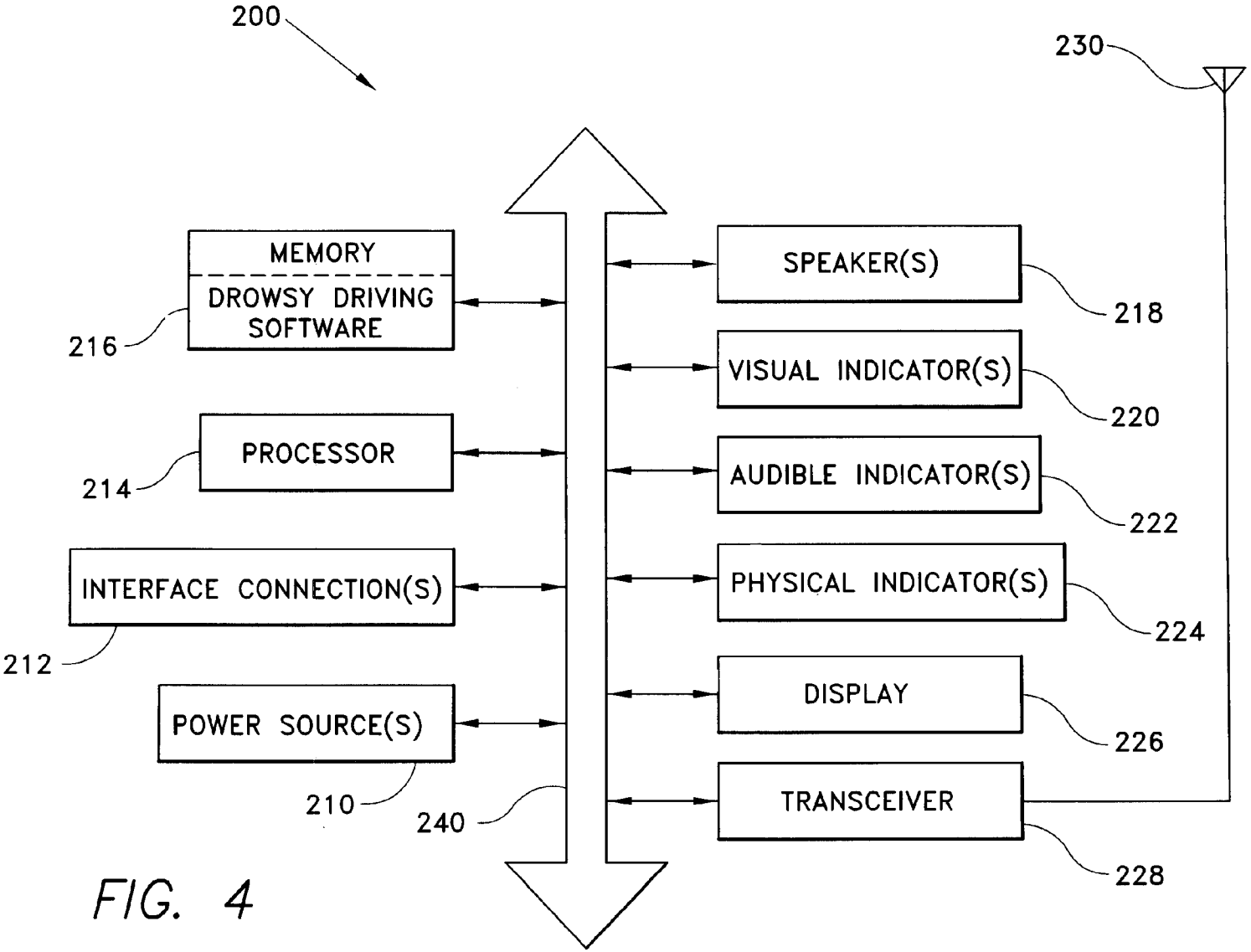
FIG. 4 is a block diagram of an indicator mechanism of a drowsy driving alarm system according to the invention.

Referring to FIGS. 2-4, the drowsy driving alarm system includes a monitoring mechanism 100 and an indicator mechanism 200. The monitoring mechanism 100 in FIG. 1 is configured with an optional DC power adapter 160 to interconnect with a DC power socket in the dash area of the vehicle 20. The monitoring mechanism 100 is illustrated in an active mode where the individual P has provided an indication of becoming drowsy. The monitoring mechanism 100 has detected the drowsiness of the driver P and has activated an audible alarm A. As shown in FIG. 2, the monitoring mechanism 100 includes one or more power sources 110, one or more interface connections 112, a processor 114, a camera 116, and one or more speakers 118. The monitor 100 can also include one or more visual indicators 120, one or more audible indicators 122, one or more physical indicators 124, a microphone 126, a transceiver 128, an antenna 130, one or more sensors 132 and a compass 134. These components are communicatively interconnected by a communication bus 140.

The monitoring mechanism 100 is preferably configured in the form of small assembly for wearing on the ear of an individual, such as in the form of a microphone for individuals that can be interconnected to their cell phone or computer. However, the monitoring mechanism 100 can be configured in other particular configurations as desired. As illustrated the monitoring mechanism 100 includes an ear cradle to cradle the ear. Attached to the ear cradle is an element for positioning against the ear that contains the speaker(s) 118. Extending from the ear cradle is a longitudinal arm with the camera 116 positioned at the end of the arm. The arm is pivotally attached to the ear cradle to enable the position of the arm to be easily adjusted so a user can properly position the end of the arm so the camera is able to view the pupil area of the eye of the individual P. Once adjusted, the arm supports the camera 116 in a manner to substantially fix the position of the camera 116 relative to a position of the pupil of the user's eye.

The power source 110 can be a rechargeable and/or non-rechargeable battery. The power source 110 can also be external to the monitoring mechanism 100 and be provided via a power cord or the like, such as the DC adapter illustrated in FIG. 1 for attaching to a cigarette lighter socket or power socket. The monitoring mechanism 100 can also be configured to be powered from an AC power source.

The interface connections 112 can be configured in the form input/output jacks to enable input and/or output to be provided to the monitoring mechanism 100 (e.g., from the indicator mechanism 200 or another device, such as a cell phone or the like). The interface connection(s) 112 can also include elements such as a button, key, or the like, so a user may touch, hit, or otherwise engage the elements to affect a certain result. For example, a volume knob can be provided on the monitoring mechanism 100 to enable the user to adjust the volume of the alarm emitted by the monitoring mechanism 100.

The processor 114 can be any type of processor or an application specific integrated chip configured with drowsy driving software embedded therein. The processor can be small in size, relatively inexpensive relative to typical processor chips (e.g. Pentium, Athlon, etc.). The processor 114 processes all signals from the components of the monitoring mechanism 100 to properly cause an alarm to be produced when conditions corresponding to a drowsy driver are detected.

The camera 116 is configured to monitor the pupil of the eye of a user. The camera 116 can be an analog and/or digital video camera. For situations where the user's eye is insufficiently illuminated to differentiate the pupil, a light source may be mounted on camera 116 to illuminate the eye. Light sources which may be used depending upon the application include incandescent lights, lighting through fiber optic cables, visible-light LEDs, and infrared-light LEDs. However, because CCD video cameras are extremely sensitive to infrared illumination, it is preferred that infrared LEDs be used as the light source. Infrared LEDs are also valuable because IR light is not visible to the user.

Miniature CMOS camera technology can be utilized in the form of CIF/VGA, etc., which are manufactured by companies such as Agilent Technologies, Micron Technologies, Motorola, etc. Other camera configurations can also be utilized. The processor 114 can process analog video data from the camera 116 and convert the analog video data to digital pixel data. The processor 114 can also process digital video data from the camera 116 and convert the digital video data to digital pixel data. Process of a proprietary algorithm is then used to determine if the user is drowsy.

Visual indicator(s) 120, if included, are configured to provide a visual indication for indicating a predetermined parameter condition. For example, the predetermined parameter can be associated with the position of the camera 116. When the camera 116 is not in a position to properly see the pupil of the eye of the individual P, the visual indicator(s) 120 can provide a red or other indication through an LED or the like. When the camera 116 is in a position to properly see the pupil of the eye of the individual P, the visual indicator(s) 120 can provide a green or other indication through an LED or the like.

The visual indicator(s) 120, if included, can be configured to provide a visual indication for indicating a predetermined parameter condition. For example, the predetermined parameter can be associated with the position of the camera 116. When the camera 116 is not in a position to properly see the pupil of the eye of the individual P, the visual indicator(s) 120 can provide a red or other indication through an LED or the like. When the camera 116 is in a position to properly see the pupil of the eye of the individual P, the visual indicator(s) 120 can provide a green or other indication through an LED or the like. When detection by the camera 116 occurs of a drowsy driver, the visual indicator(s) 120 can blink a red or other light at a rapid pace. Such a visual indicator 120 can emit light to provide the visual indication and can be an LED of any desired color, but may be any type of light.

The audible indicator(s) 122, if included, can be provided through the speaker 118 that is powered by an amplifier to emit any distinctive audible sound, such as a buzzer, chirp, chime, or the like. Alternatively, the audible indicator 122 can relay audible communication information, such a recorded message, a relayed communication message, or the like, from the indicator mechanism 200. The physical indicator(s) 124, if included, can be provided to produce a physical movement of the monitoring mechanism 100, such as a vibration or the like, when detection by the camera 116 occurs of a drowsy driver.

The microphone 126, if provided is to enable the monitoring device to be compatible with devices such as cell phones so the user does not need to wear an additional hands free earpiece. The transceiver 128 can be of a type well known in the art, and is preferably constructed of miniaturized solid state components so the transceiver 128 can be removably received in the monitoring mechanism 100. The transceiver 128 can establish a two-way wireless communication link between the monitoring mechanism 100 and the indicator mechanism 200 by way of the antenna 130.

The sensor(s) 132 and compass 134 can be provided to enable the monitoring mechanism 100 to determine if the user is not looking in a predetermined direction, for example, the road ahead for a driver, for a predetermined amount of time.

As shown in FIGS. 3 and 4, the drowsy driving alarm system also includes an indicator mechanism 200. The indicator mechanism 200 is preferably configured in the form of a handheld device such as an iPod, Palm Pilot, personal digital assistant (PDA), etc., that can be clipped on and/or attached to the belt or clothing waist of a user. The individual P can have the indicator mechanism 200 attached about his/her waist. The indicator mechanism 200 can be interconnected with the monitoring mechanism 100 wirelessly via communication link L1 and/or non-wirelessly via wiring W. The monitoring mechanism 100 has detected the drowsiness of the driver P and has activated an audible alarm A. Activation of the monitoring mechanism 100 can also cause visual indicators 220 and/or audible indicators 222 to become active on the indicator mechanism 200. Text messaging can be displayed on the display 224.

The indicator mechanism 200 includes one or more power sources 210, one or more interface connections 212, a processor, and memory carrying with drowsy driving software 216. The indicator mechanism 200 can also include one or more speakers 218, one or more visual indicators 220, one or more audible indicators 222, one or more physical indicators 224, a display 226, a transceiver 228, and an antenna 230. These components are communicatively interconnected by a communication bus 240.

The power source 210 can be a rechargeable and/or non-rechargeable battery. The power source 210 can also be external to the indicator mechanism 200 and be provided via a power cord or the like, such as the DC adapter for attaching to a cigarette lighter socket or power socket. The indicator mechanism 200 can also be configured to be powered from an AC power source.

The interface connections 212 can be configured in the form input/output jacks to enable input and/or output to be provided to the indicator mechanism 200 (e.g., from the monitoring mechanism 100 or another device, such as a cell phone or the like). The interface connection(s) 212 can also include elements such as a button, key, or the like, so a user may touch, hit, or otherwise engage the elements to affect a certain result. For example, a volume knob can be provided on the indicator mechanism 200 to enable the user to adjust the volume of the alarm emitted by the monitoring mechanism 100.

The processor 214 can be any type of processor or an application specific integrated chip configured with drowsy driving software embedded therein. The processor can be small in size, relatively inexpensive relative to typical processor chips (e.g. Pentium, Athlon, etc.). The processor 214 processes all signals from the components of the indicator mechanism 200 to properly process signals received from the camera 116 of the monitoring mechanism 100 as well as to enable the user to provide operational settings to the drowsy driving alarm system. The memory 216 contains drowsy driving software therein.

Speaker(s) 218, if any, can provide audible sound as desired. Visual indicator(s) 220, if included, are configured to provide a visual indication for indicating a predetermined parameter condition. For example, the predetermined parameter can be associated with the position of the camera 116 of the monitoring mechanism 100. When the camera 116 is not in a position to properly see the pupil of the eye of the individual P, the visual indicator(s) 220 can provide a red or other indication through an LED or the like.

When the camera 116 is in a position to properly see the pupil of the eye of the individual P, the visual indicator(s) 220 can provide a green or other indication through an LED or the like. When the visual indicator(s) 220, if included, is configured to provide a visual indication for indicating a predetermined parameter condition. For example, the predetermined parameter can be associated with the position of the camera 116 of the monitoring mechanism 100. When the camera 116 is not in a position to properly see the pupil of the eye of the individual P, the visual indicator(s) 220 can provide a red or other indication through an LED or the like.

When the camera 116 is in a position to properly see the pupil of the eye of the individual P, the visual indicator(s) 220 can provide a green or other indication through an LED or the like. When detection by the camera 116 occurs of a drowsy driver, the visual indicator(s) 220 can blink a red or other light at a rapid pace. Such a visual indicator 220 can emit light to provide the visual indication and can be an LED of any desired color, but may be any type of light. The visual indicator(s) 220 can be external to the indictor mechanism 200. For example, the visual indicator(s) 220 can be placed the dashboard and/or in some other placed on the vehicle where co-passengers could also see them.

The audible indicator(s) 222, if included, can be provided through the speaker(s) 218 that are powered by an amplifier to emit any distinctive audible sound, such as a buzzer, chirp, chime, or the like. Alternatively, the audible indicator 222 can relay audible communication information, such a recorded message, a relayed communication message, or the like, from the monitoring mechanism 100. The speaker(s) 218 can also be external to the indicator device 200. For example, the speaker(s) 218 can be fitted on the dashboard of a vehicle or behind the back seat or, alternatively so output could be heard through the speakers of the vehicle's stereo system. The physical indicator(s) 224, if included, can be provided to produce a physical movement of the indicator mechanism 200, such as a vibration or the like, when detection by the camera 116 occurs of a drowsy driver.

The transceiver 226 can be of a type well known in the art, and is preferably constructed of miniaturized solid state components so the transceiver 226 can be removably received in the indicator mechanism 200. The transceiver 226 can establish a two-way wireless communication link between the monitoring mechanism 100 and the indicator mechanism 200 by way of the antenna 218.

The transceivers 126 and 226 described above are configured to wirelessly transmit and/or receive information over a communication link L1 using any desired RF frequency, such as unlicensed radio, optical transmission, Infrared Data Association (IrDA) compliant, BlueTooth, 802.11 Standard, WiFi, or any other RF data communications protocol compliant methods. For example, the transceivers 126 and 226 can transmit and/or receive information using BlueTooth or WiFi communication protocols. BlueTooth and WiFi devices are designed to transmit short bursts or packets of data over short ranges using unlicensed high-frequency channels such as the 2.4 GHz frequency band. Such communication protocols typically establish a frequency-hopping radio link using many different frequencies at approximately 1 MHz intervals to give a high degree of immunity from interference with other transmissions.

Figure 5:
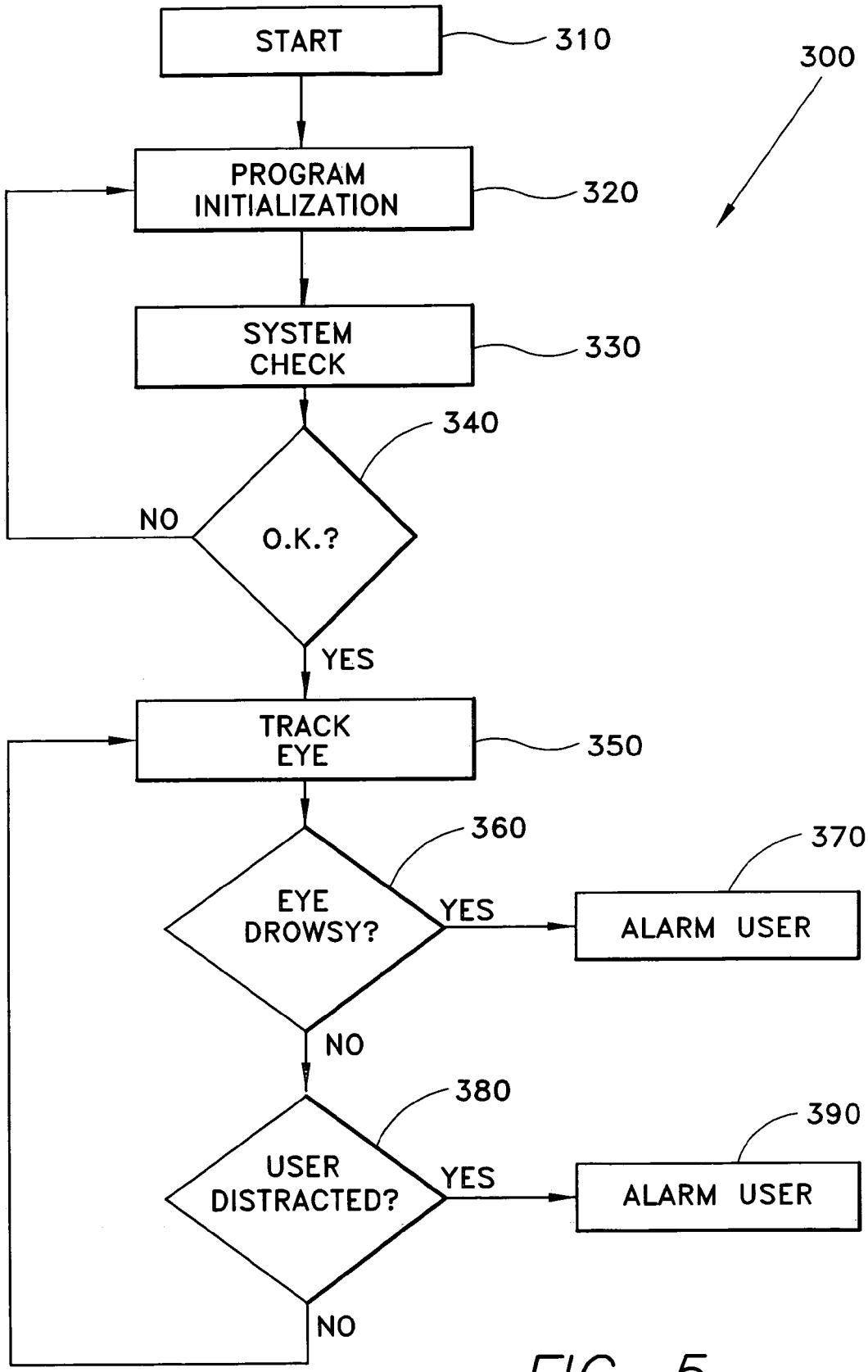
FIG. 5 is a flow chart of a drowsy driving process effected by a drowsy driving alarm arrangement according to the present invention.

Referring to FIG. 5, an image 300 of a drowsy driving process flow is shown that occurs with the drowsy driving alarm system. The drowsy driving alarm system is activated 310. Program initialization 320 then occurs. The drowsy driving software conducts a system check 330 to determine if all components of the drowsy driving alarm system or operating properly 340. If the drowsy driving alarm system is not operational sound, the process returns to the program initialization to essentially reboot the system. If the drowsy driving alarm system is operationally sound, the camera of the monitoring mechanism tracks the eye of the user. A determination as to whether the eye is drowsy is made 360. The user is alarmed 370 if a determination is made that the eye is drowsy. Otherwise the drowsy driving alarm system determines whether the user is distracted 380. If the user is distracted or not looking in a predetermined direction, the user is alarmed 390. The process continues until the drowsy driving alarm system is deactivated.

The drowsy driving alarm system warns the driver before the driver falls asleep. When the driver's eyes droop before he/she falls asleep, his/her eyelids get 'heavy', e.g., the frequency of normal eye blinking becomes less and less, and ultimately it becomes zero for a prolonged time (condition of sleep). Normal blinking lasts for 50-100 ms but when the eyes get 'heavy' blinking can easily last for 500-1000 ms (1 second). The drowsy driving alarm system identifies and warns the driver (by alarm/lights as mentioned earlier) when his/her eye is closed for preferably about 1-1.5 seconds continuously. This period can be varied as desired. A period of 1-1.5 second is reasonable as longer duration may cause damage (accidents) and shorter durations might falsely trigger a warning (alarm/lights).

During setup operation of the drowsy driving alarm system a clear image of the eye is obtained. To get a clear image the user adjusts the intensity of the camera and adjusts the setting on the display 224. When a raw image of the eye is obtained, it is converted into digital image. The output of the camera 224 can be in typical red-green-blue (RGB). The camera can provide YCrCb output for backward compatibility. Other output types can be utilized as desired.

With YCrCb the drowsy driving software considers the 'Y' part of the output and ignores the 'CrCb' part. Here the threshold parameter is 'Y' (intensity) output. When the eye is closed the intensity drops considerably. The alarm can sound when the intensity drops to around 60% of the normal intensity. The threshold intensity can be customized and adjusted through a switch.

Inexpensive CMOS cameras have a capacity of up to 25 frames per second. The drowsy driving alarm system can adequately utilize a rate of 4-5 frames per seconds to get the required data. Typically each pixel of the output image from a video camera with 8 bit raw RGB output has RGB value that lies between 0 and 255 where a RGB combination of 0,0,0 (e.g., Red value=0, Green value=0, and Blue value=0) represents the color BLACK; and an RGB combination of 255,255,255 (i.e. Red value=255, Green value=255, and Blue value=255) represents a WHITE color. The camera 116 can be used to get an image with all pixels having RGB values between 0 and 255. Small video displays with resolutions 160×132, 176×144 and up can be useful for the drowsy driving alarm system.

For example, consider the case of a display with a resolution 176×144. In this display there are 176 horizontal and 144 vertical pixels representing image as seen by the video camera 116 (per frame). Each pixel has an RGB value between 0 and 255. During the set up the user can set the threshold for each color individually, such as Red=100, Green=110 and Blue=120. The default setting could be 100,100,100. The drowsy driving software can convert each pixel either into a 'black' pixel {RGB (0,0,0)} if its RGB value is less than the preset threshold already set by the user. Otherwise the drowsy driving software can make the pixel a white pixel {RGB (255,255,255)}.

If one particular pixel has a value of RGB (50,60,70) then the drowsy driving software can make that pixel a 'BLACK' pixel on the screen as its RGB value is less that the threshold (Red 50<100, Green 60<110 and Blue 70<120). On the other hand a pixel with value of (175,170,165) will be converted into 'WHITE' pixel (red 175>100 and 170>110 and 165>120). For each frame the drowsy driving software calculates the number of black pixels. When the eye is completely open the number of black dots per frame is around the same. The total is kept in memory as 'normal black density'.

When the user's eye is closed, the number of black pixels reduces drastically, in some cases more than 80%. In a typical scenario, however, the number of black pixels are around one hundred and when the eye is closed the number of black pixels reduces to thirty. The drowsy driving software triggers drowsiness alarm/lights when the 'black density' (number of black pixels in a particular frame) for three to four successive frames is significantly lesser than the 'normal black density'. This 'black density threshold value' can be set to a desired predetermined value. The default value can be set to a predetermined number such as 60%.

As previously described, the drowsy alarm system can also be utilized by third parties, such as employers or the like, to monitor the drowsiness of their employees from a remote location. For example, an employer could require certain employees to wear a drowsy driving alarm system, and monitor those employees from a remote location, such as from a remote computer arrangement or monitoring arrangement. The employer may also configure the alarm system for the employee, so the employee would not be alerted by any audible, visual, and/or physical indicators, but a viewer at the remote location could be alerted to the drowsiness of a particular employee by a predetermined audible, visual, and/or physical indicator.

In summary, the drowsy driving alarm system includes a monitoring mechanism with a camera and an indicator mechanism carrying drowsy driving software and a processor to process data received from the camera regarding drowsiness of a user of the drowsy driving alarm system. The monitoring mechanism can include at least one power source, at least one interface connection, at least one speaker, and a communication bus communicatively interconnecting elements of the monitoring mechanism. The monitoring mechanism can include at least one visual indicator, at east one audible indicator, and/or at least one physical indicator. The monitoring mechanism can include a microphone, a transceiver and an antenna. The monitoring mechanism can also include at least one sensor and a compass.

The monitoring mechanism includes an ear cradle to cradle the ear, and a longitudinal arm with the camera positioned at an end of the arm, the arm being pivotally attached to the ear cradle to enable the position of the arm to be adjusted. A light source can be mounted on the camera. The longitudinal arm substantially fixes the camera relative to a position of a pupil of the user's eye.

The indicator mechanism can include at least one display, at least one visual indicator, and a communication bus interconnecting elements of the indicator mechanism. The indicator mechanism can include at least one power source, and at least one interface connection. The indicator mechanism can include at least one audible and/or physical indicator.

The drowsy driving software, when executed by the processor of the indicator mechanism, causes the indicator mechanism to carry out steps including effecting program initialization of the drowsy driving alarm system; conducting a system check to determine whether components of the drowsy driving alarm system are operating properly; and tracking the eye of a user with the camera if the drowsy driving alarm system is operationally sound.

The conducting a system check step further causes the indicator mechanism to return to the program initialization step if the drowsy driving alarm system is not operationally sound. The drowsy driving software, when executed by the processor of the indicator mechanism, can further cause the processor of the indicator mechanism to carry out steps including determining whether an eye of a user is drowsy, and alarming the user if a determination is made that the eye is drowsy. The drowsy driving software, when executed by the processor of the indicator mechanism, further causes the processor of the indicator mechanism to carry out steps including determining whether the user is distracted or not looking in a predetermined direction, and alarming the user if the user is distracted or not looking in a predetermined direction, the user is alarmed.

A drowsy driving alarm method includes: effecting program initialization of the drowsy driving alarm system; conducting a system check to determine whether components of the drowsy driving alarm system are operating properly; and tracking the eye of a user with the camera if the drowsy driving alarm system is operationally sound.

The conducting a system check step returns to the program initialization step if the drowsy driving alarm system is not operationally sound. The drowsy driving alarm method also determines whether an eye of a user is drowsy, and alarms the user if a determination is made that the eye is drowsy. The drowsy driving alarm method also determines whether the user is distracted or not looking in a predetermined direction, and alarms the user if the user is distracted or not looking in a predetermined direction.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

We claim:

1. A drowsiness alarm system, comprising:

a monitoring mechanism having a camera configured for monitoring a pupil of an eye of a subject in order to produce video data corresponding to an image of the eye, the monitoring mechanism further having a monitor processor and a communication bus connecting the processor to the camera, the monitor processor being configured for converting video data received from the camera into digital pixel data in RGB format; and an indicator mechanism having a processor configured to process data received from the monitoring mechanism regarding drowsiness of the subject of the drowsiness alarm system, including:

a circuit configured for determining density of black pixels per image frame in the data;

a circuit configured for setting a threshold value of the density of black pixels per image frame in a selectable number of consecutive frames to indicate drowsiness;

a circuit configured for turning the indicator mechanism on in order to signal that the subject is drowsy when the determined density of black pixels falls below the threshold value in the selected number of consecutive frames; and a circuit configured for permitting the subject to programmably set threshold red, green and blue values, digital pixel data falling below the threshold RGB values being counted as a black pixel by the circuit configured for determining density of black pixels per image frame.

2. The drowsiness alarm system according to claim 1, wherein said camera comprises an analog camera.

3. The drowsiness alarm system according to claim 1, wherein said camera comprises a digital camera.

4. The drowsiness alarm system according to claim 1, wherein said monitoring mechanism further comprises at least one indicator selected from the group consisting of a visual indicator, an audio indicator, and a physical indicator, the indicator being connected to said monitor processor by the communication bus, the processor being configured to turn the indicator on to signal the subject when said camera is not focused on the pupil of the subject's eye.

5. The drowsiness alarm system according to claim 1, wherein said monitoring mechanism further comprises at least one indicator selected from the group consisting of a visual indicator, an audio indicator, and a physical indicator, the indicator being connected to said monitor processor by the communication bus, the processor being configured to turn the indicator on when the determined density of black pixels falls below the threshold value in the selected number of consecutive frames in order to signal that the subject is drowsy.

6. The drowsiness alarm system according to claim 1, wherein said monitoring mechanism further comprises:

an ear cradle to cradle the ear; and a longitudinal arm with the camera positioned at an end of the arm, the arm being pivotally attached to the ear cradle to enable the position of the arm to be adjusted.

7. The drowsiness alarm system according to claim 6, wherein said monitoring mechanism further comprises:

a light source mounted on the camera.

8. The drowsiness alarm system according to claim 6, wherein said longitudinal arm substantially fixes the camera relative to a position of a pupil of the user's eye.

9. The drowsiness alarm system according to claim 1, wherein said indicator mechanism is configured to enable monitoring of drowsiness of a user by a third party at a remote location.

10. The drowsiness alarm system according to claim 1, wherein said indicator mechanism further comprises:

at least one display;

at least one visual indicator; and a communication bus interconnecting said circuits, the at least one display, and the at least one visual indicator.

11. The drowsiness alarm system according to claim 10, wherein said indicator mechanism further comprises:

at least one audible indicator connected to the communication bus.

12. The drowsiness alarm system according to claim 10, wherein said indicator mechanism further comprises:

at least one physical indicator connected to the communication bus.

13. The drowsiness alarm system according to claim 10, wherein said indicator mechanism further comprises:

at least one power source; and at least one interface connection, the interface connection being connected to the communication bus.

* * * * *